US010329757B1

(12) United States Patent
Waite

(10) Patent No.: US 10,329,757 B1
(45) Date of Patent: Jun. 25, 2019

(54) TOILET AND DRAIN PLUNGER

(71) Applicant: Jeff Waite, Iowa City, IA (US)

(72) Inventor: Jeff Waite, Iowa City, IA (US)

( * ) Notice: Subject to any disclaimer, the term of this patent is extended or adjusted under 35 U.S.C. 154(b) by 0 days.

(21) Appl. No.: 15/599,705

(22) Filed: May 19, 2017

Related U.S. Application Data

(60) Provisional application No. 62/339,380, filed on May 20, 2016.

(51) Int. Cl.

| | |
|---|---|
| ***E03D 9/00*** | (2006.01) |
| ***E03C 1/308*** | (2006.01) |
| *E03C 1/12* | (2006.01) |
| *E03C 1/30* | (2006.01) |
| *E03C 1/304* | (2006.01) |
| *E03D 11/00* | (2006.01) |

(52) U.S. Cl.
CPC ..... *E03D 9/00* (2013.01); *E03C 1/12* (2013.01); *E03C 1/30* (2013.01); *E03C 1/304* (2013.01); *E03C 1/308* (2013.01); *E03D 11/00* (2013.01)

(58) Field of Classification Search
CPC ..... E03D 9/00; E03C 1/308
See application file for complete search history.

(56) References Cited

U.S. PATENT DOCUMENTS

| | | | | |
|---|---|---|---|---|
| 1,152,981 | A * | 9/1915 | Schacht | E03C 1/308 116/DIG. 24 |
| 2,203,185 | A * | 6/1940 | Walus | E03C 1/308 4/255.11 |
| 2,473,452 | A * | 6/1949 | Scott | E03C 1/308 15/104.33 |
| 3,021,532 | A * | 2/1962 | Gross | E03C 1/308 4/255.11 |
| 5,239,708 | A * | 8/1993 | Irwin | E03C 1/308 4/255.03 |
| 7,062,800 | B1 * | 6/2006 | Alfred | E03D 9/00 4/255.01 |
| D798,512 | S * | 9/2017 | Newman | D32/14 |
| 2010/0132102 | A1 * | 6/2010 | Flamand | E03C 1/308 4/255.11 |
| 2010/0313345 | A1 * | 12/2010 | Stein | E03C 1/308 4/255.11 |
| 2014/0033419 | A1 * | 2/2014 | Daciw | E03D 9/00 4/255.11 |
| 2014/0115768 | A1 * | 5/2014 | Wang | E03D 9/00 4/255.11 |

* cited by examiner

*Primary Examiner* — Janie M Loeppke
(74) *Attorney, Agent, or Firm* — Shuttleworth & Ingersoll, PLC; Jason Sytsma

(57) ABSTRACT

A working end of a plunger comprises of a neck for combining the working end to the handle, a bell combined to the neck and defining an interior cavity, and at least two reinforcement members extending on an outer surface of the bell from the neck down toward at least one rib extending around a circumference of the bell.

13 Claims, 3 Drawing Sheets

SECTION A–A

TOILET AND DRAIN PLUNGER

This application claims priority to U.S. Provisional Application No. 62/339,380 filed on May 20, 2016, the contents of which are hereby incorporated by reference herein.

This disclosure relates to a toilet and drain plunger, and, more specifically, this disclosure relates to an improved toiled and drain plunger for clearing blockages in toilets and drain lines.

BACKGROUND

Conventional toilet plungers of the type with a rigid handle and compressible bell are widely used for clearing minor blockages in toilets and drain lines. Generally, the bell of the plunger is made of a resiliently deformable material in a substantially circular, rounded, open, cup-like configuration, and it is formed with an open interior area or cavity which opens outwardly through the open end of the bell. The handle of the plunger of this general type is generally made from a relatively rigid material, such as wood or plastic, and it is connected to the bell so that it extends from the end thereof which is opposite the open end. A plunger of this general type is operable by first positioning the bell so that it is in substantially sealed engagement with the outlet portion of a toilet bowl or with a fixture, such as a shower stall, around the drain therein. The handle element is then reciprocally moved toward and away from the bell so that the bell is alternately deformed and returned to an undeformed condition in order to alternately apply pressure and suction to the outlet portion of the toilet or the drain.

While plungers of the above-described general type have, for the most part, been found to be effective, they have been found to have a few drawbacks. Sometimes the bell caves in on the side causing the bell to unseal from the outlet portion of the toilet or the drain. When this occurs in the toilet, this can cause splash back to the user. Also, recently developed high efficiency toilets have oval shaped outlet portions that are difficult to seal with the standard plunger. What is needed is an improved toilet and drain plunger that solves these problems.

SUMMARY

Disclosed is a plunger comprising a handle for holding and manipulating the plunger with a working end attached to one end of the handle. The working end comprises of a neck for combining the working end to the handle, a bell combined to the neck and defining an interior cavity, and at least two reinforcement members extending on an outer surface of the bell from the neck down toward the end of the bell. In the illustrated embodiment, five reinforcement members are spaced a substantially equal distances apart around the outer surface of the bell.

The bell further comprises of an area of transition on an outer surface of the working end between the neck and the bell. The at least two reinforcement members reinforce the area of transition for increased stability. A threaded bore is in the neck to receive the threaded handle. The threaded bore can extend to a depth in line with the area of transition between the neck and the bell so as to not reduce the volume of air inside the internal cavity of the bell.

A plurality of ribs can extend around the circumference of the bell. The ribs cooperate with a sealing surface on a bottom surface of the bell to help the sealing surface deform to the shape of the drain yet retain some rigidity. A bevel can extend downward from the sealing surface to similarly deform to the shape of a toilet drain to help seal the drain so the full volume of air from inside the internal cavity of the bell is transferred into the drain.

DETAILED DESCRIPTION

Figure 1:
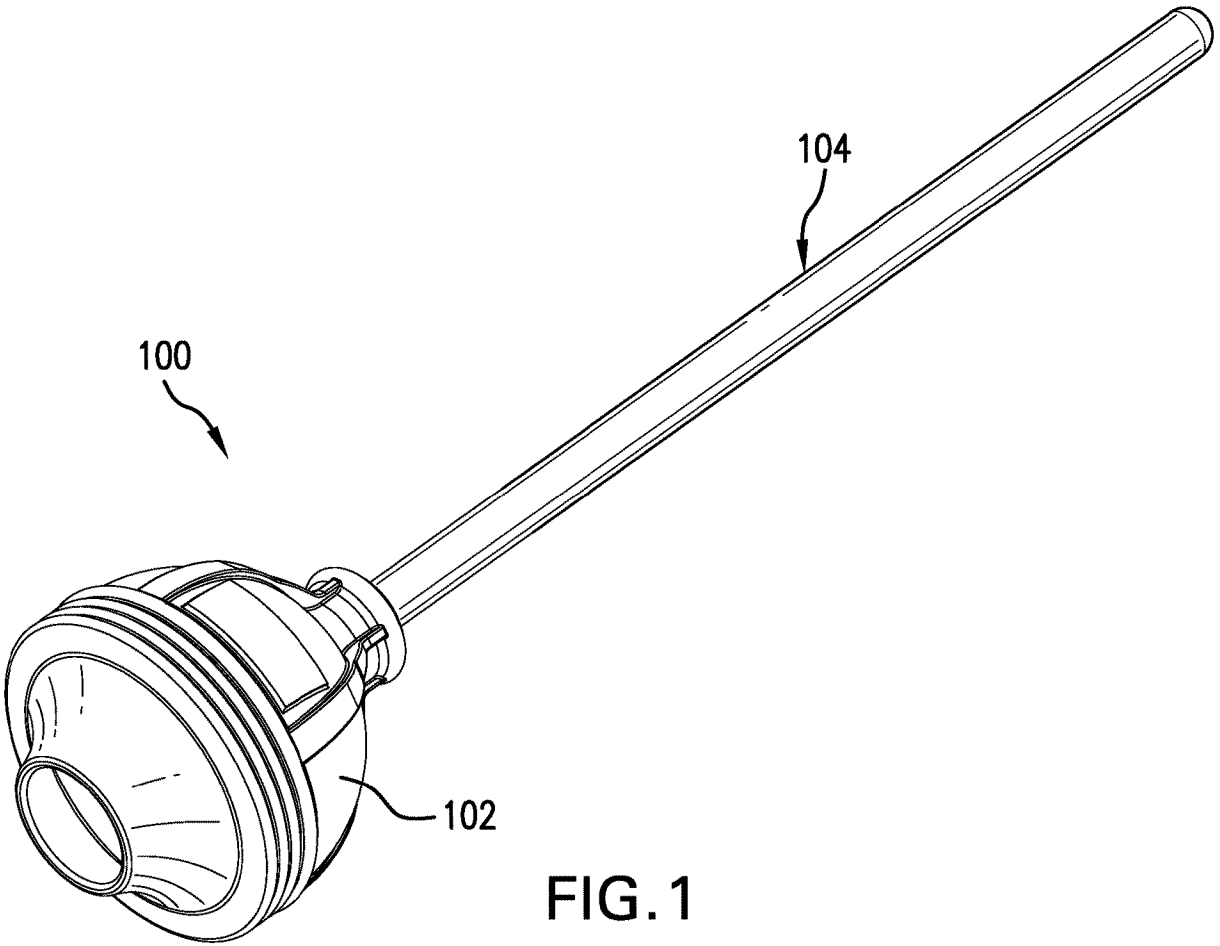
FIG. 1 is a perspective view of an improved toilet and drain plunger according to this disclosure.

FIG. 1 shows a plunger 100 according to this disclosure. Plunger 100 generally comprises of a working end 102 and a handle 104. Working end 102 comprises generally of a neck 106 that attaches working end 102 to handle 104, a bell 116 that defines an internal cavity 112 for a volume of air, and a bevel 108 that channels a volume of air from inside working end 102 into the drain.

Figure 4:
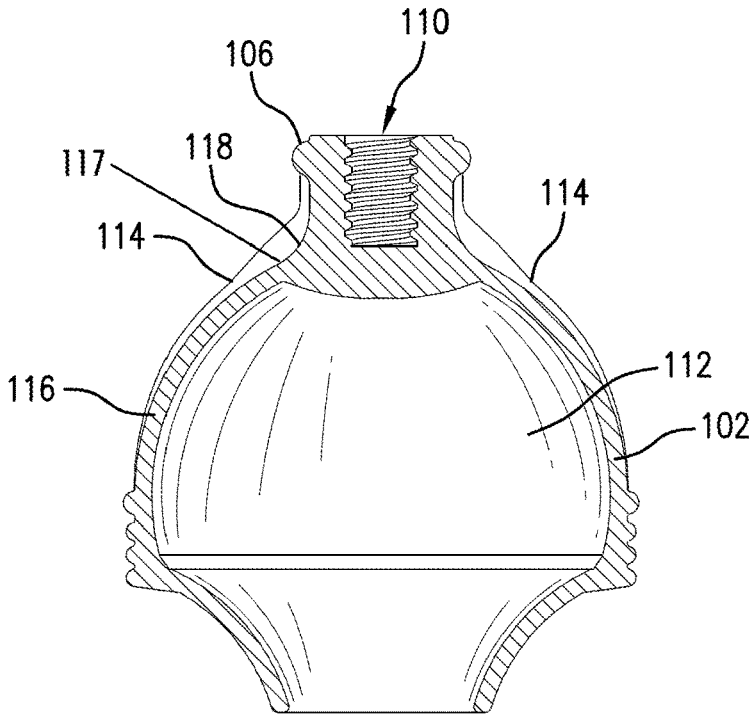
FIG. 4 is a cross-sectional view of the working end of the plunger of FIG. 1.

More particularly, as shown in FIG. 4, neck 106 is a substantially solid mass of material with an internally threaded bore 110. Bore 110 extends down the neck, but, importantly, not into the internal cavity 112 of working end 102 to decrease the volume of air inside the cavity. In this regard, bore 110 extends a depth in line with an area of transition 118 between neck 106 and bell 116. This allows for an increased stroke of handle 104 to force a maximum amount of air in internal cavity 112 out through bevel 108.

Bell 116 of working end 102 is substantially bell-shaped with a hollow interior that defines internal cavity 112. Working end 102 has at least two reinforcement members 114 that begin at neck 106 and extend toward the end of the bell 116, which stabilize bell 116 so that it substantially retains its shape when plunger 100 is in use. In the illustrated embodiment, working end 102 has five reinforcement members 114 substantially equal distances apart around the outer surface of bell 116. These reinforcement members 114 further increase the stability of bell 116 so that it will not turn inside out in use.

Figure 2:
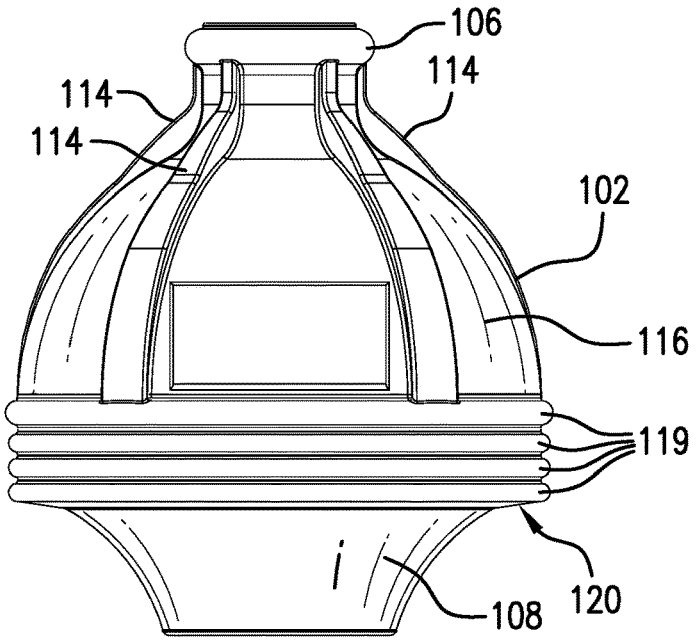
FIG. 2 is a side view of the working end of the plunger of FIG. 1.
Figure 3:
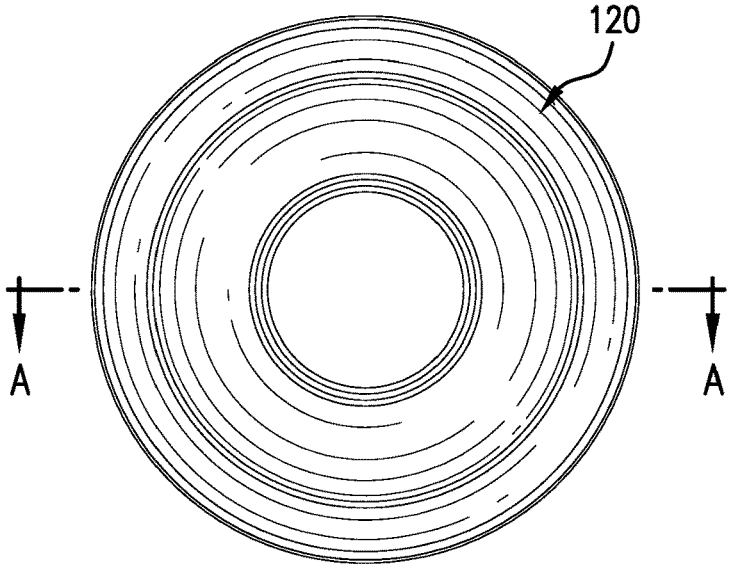
FIG. 3 is a bottom view of the working end of the plunger of FIG. 1.
Figure 5:
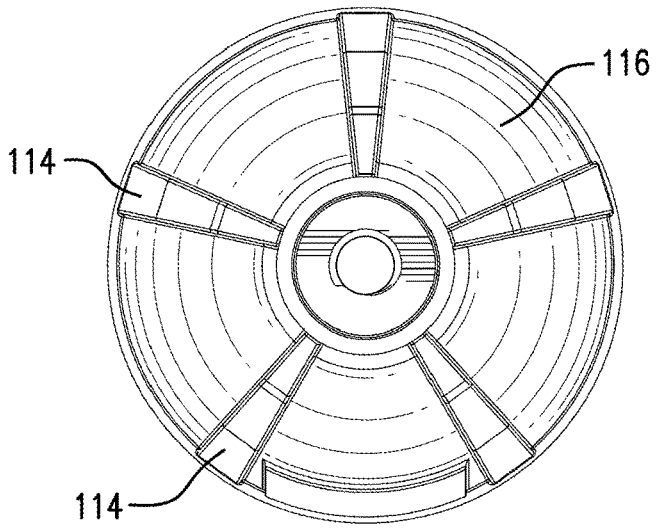
FIG. 5 is a top view of the working end of the plunger of FIG. 1.

Reinforcement members 114, as shown in FIGS. 2 and 5, each have substantially the same shape. Reinforcement members 114 go against the contour of neck 106 forming an inverted-arc or an opposing radius 117 between neck 106 and bell 116 that matches the radius between neck 106 and bell 116 and opposes the inward flexion in the area of transition 118 between neck 106 and bell 116 during the use of plunger 100. Opposing radius 117 creates a thickness of material that is generally thickest in the area of transition 118 between neck 106 and bell 116 to provide support for working end 102. In other words, reinforcement members 114 add additional structural support in area of transition 118 (which can be a radius) between neck 106 and bell 116. This additional structural support means that neck 106 will generally always move in linear path of travel maintaining substantially the outer shape of bell 116 and causing a maximum volume of air to be forced out of internal cavity 112.

The bottom of bell 116 has at least one and preferably a plurality of ribs 119 extending around the circumference of bell 116 that circumscribe an outer circumference of the bottom of bell 116. Ribs 119 provide stability during flexion of bell 116 when in use so that the sealing face 120 maintains its seal during use. This will be better understood in connection with the discussion of a sealing face 120 and how plunger 100 is operated.

The bottom underside of bell 116 comprises of a sealing face 120 that fits around the drain (whether a floor drain or a toilet drain) and provides a seal between internal cavity 112 and the drain so that the volume of air inside internal cavity 112 is transferred into the drain, and not leaked out the side. From the inner circumference of sealing face 120, a bevel 108 extends down. Bevel 108 is designed to either fold inward when plunger 100 is used on a floor drain or deform to an oval shape of a trough in a toilet drain at the bottom of the toilet bowl.

When plunger 100 is used, handle 104 is forced downward causing the neck 106 to move linearly inward toward internal cavity 112. This downward force also forces bevel 108 down (with the general downward movement of plunger 100) into the trough of the toilet drain. The outer contour of bevel 108 can similarly deform to an oval shape as it is forced into the trough of the toilet drain and sealing face 120 seals against the outer rim of the toilet drain. Ribs 119 provide structural support around the outer circumference of bell 116 so that bevel 108 can deform without buckling the sides of bell 116.

When plunger 100 is being used on a floor drain, bevel 108 folds inward and sealing face 120 seals around the perimeter of the drain. The downward fore of handle 104, pushes the volume of air inside internal cavity 112 into the drain. Most importantly, the reinforcement members 114 prevent one side of bell 116 from buckling inward.

The foregoing description describes a plunger 100 that is sufficiently rigid so that bell 116 substantially maintains its geometry during use. Bell 116 won't buckle inward under the force of use causing a break in the seal or throwing water back up at the user. This allows a maximum volume of air from inside internal cavity 112 to be transferred down into the drain for maximum efficiency.

What is claimed is:

1. A plunger comprising:

a handle for holding and manipulating the plunger; and a working end attached to one end of the handle, the working end comprising a neck for combining the working end to the handle, a bell substantially bell-shaped with a hollow interior combined to the neck and defining an interior cavity, an area of transition comprising a radius between the neck and the bell on an outer surface of the working end between the neck and the bell, and at least two reinforcement members extending on an outer surface of the bell from the neck down toward the end of the bell and each having an opposing radius that matches the radius in the area of transition between the neck and the bell that adds a thickness of material to each of the at least two reinforcement members in the area of transition that is thickest in the area of transition and that is more than a thickness of the at least two reinforcement members outside the area of transition on the neck and the bell for opposing an inward flexion in the area of transition, and wherein the thickness of material of the at least two reinforcement members reinforce the area of transition for increased stability, and wherein the thickness of material forms an opposing radius between the neck and the bell that matches the radius between the neck and the bell and opposes the inward flexion in the area of transition between the neck and the bell during the use and the reinforcement members at the area of transition have an outer profile shape that does not match the radius of the area of transition;

a plurality of ribs extending around a circumference of the bell that increase stability of a bottom of the bell, wherein the at least two reinforcement members extend to and in contact with a top rib of the plurality of ribs; and a bevel having a circumference smaller than the bell and positioned beneath a sealing face on an underside of the bell that channels a volume of air from the interior cavity outward.

2. The plunger of claim 1, and further comprising a plurality of reinforcement members spaced a substantially equal distances apart around the outer surface of the bell.

3. The plunger of claim 1, and further comprising a threaded bore in the neck to receive the handle.

4. The plunger of claim 3, wherein the threaded bore extends a depth in line with an area of transition between the neck and the bell.

5. The plunger of claim 1, and further comprising at least one rib extending around a circumference of the bell.

6. The plunger of claim 5, wherein the at least two reinforcement members extend to the at least one rib.

7. The plunger of claim 1, and further comprising a sealing surface on a bottom surface of the bell.

8. The plunger of claim 7, and further comprising a bevel extending downward from the sealing surface that is deformable to a shape of a drain in use.

9. A plunger comprising:

a handle for holding and manipulating the plunger; and a working end attached to one end of the handle, the working end comprising a neck for combining the working end to the handle, a bell combined to the neck and defining an interior cavity and having a sealing surface, an area of transition comprising a radius between the neck and the bell, at least one rib extending around a circumference of the bell; and a plurality of reinforcement members extending on an outer surface of the bell from the neck down to and in contact with the at least one rib and each of the plurality of reinforcement members having an opposing radius that matches the radius in the area of transition between the neck and the bell that adds a thickness of material to each of the plurality of reinforcement members in the area of transition that is thickest in the area of transition and that is more than a thickness of the plurality of reinforcement members outside the area of transition on the neck and the bell for opposing an inward flexion in the area of transition, and wherein the thickness of material of the at least two reinforcement members reinforce the area of transition for increased stability, and wherein the thickness of material forms an opposing radius between the neck and the bell that matches the radius between the neck and the bell and opposes the inward flexion in the area of transition between the neck and the bell during the use and the reinforcement members at the area of transition have an outer profile shape that does not match the radius of the area of transition.

10. The plunger of claim 9, and further comprising a bevel extending downward from the sealing surface that is deformable to a shape of a drain in use.

11. The plunger of claim 9, wherein the reinforcement members comprise a thickness of material that is thickest in an area of transition between the neck and the bell.

12. The plunger of claim 9, and further comprising a threaded bore in the neck to receive the handle, wherein the threaded bore extends a depth in line with an area of transition between the neck and the bell.

13. A plunger comprising:

a handle for holding and manipulating the plunger; and a working end attached to one end of the handle, the working end comprising a neck for combining the working end to the handle, a bell combined to the neck and defining an interior cavity, an area of transition on an outer surface of the bell between the neck and the bell, a sealing surface on a bottom surface of the bell, a bevel extending downward from the sealing surface that is deformable to a shape of a drain in use;

a plurality of ribs extending around a circumference of the bell and a plurality of reinforcement members extending on an outer surface of the bell from the neck down to and in contact with one of the plurality of ribs, wherein the reinforcement members comprise an opposing radius forming a thickness of material that is thickest in the area of transition, a threaded bore in the neck to receive the handle that extends a depth in line with the area of transition between the neck and the bell;

at least two reinforcement members extending on an outer surface of the bell from the neck down toward the end of the bell and each having an opposing radius that matches the radius in the area of transition between the neck and the bell that adds a thickness of material to each of the at least two reinforcement members in the area of transition that is thickest in the area of transition and that is more than a thickness of the at least two reinforcement members outside the area of transition on the neck and the bell for opposing an inward flexion in the area of transition, and wherein the thickness of material of the at least two reinforcement members reinforce the area of transition for increased stability, and wherein the thickness of material forms an opposing radius between the neck and the bell that matches the radius between the neck and the bell and opposes the inward flexion in the area of transition between the neck and the bell during the use and the reinforcement members at the area of transition have an outer profile shape that does not match the radius of the area of transition.

* * * * *